US007794270B1

(12) United States Patent
Lin et al.

(10) Patent No.: US 7,794,270 B1
(45) Date of Patent: Sep. 14, 2010

(54) CONNECTOR WITH A NETWORK CABLE IDENTIFIER

(75) Inventors: Jui-Ching Lin, Taipei Hsien (TW); Cheng-Chi Chen, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/558,584

(22) Filed: Sep. 14, 2009

(30) Foreign Application Priority Data

Aug. 13, 2009 (CN) ..... 2009 1 0305582

(51) Int. Cl.
*H01R 3/00* (2006.01)

(52) U.S. Cl. ..... 439/491

(58) Field of Classification Search ..... 439/491, 439/488, 910, 668; 40/611, 642.02, 649
See application file for complete search history.

(56) References Cited

U.S. PATENT DOCUMENTS 1,373,416 A * 4/1921 Everett ..... 40/651
1,401,235 A * 12/1921 Bodin ..... 40/663
1,483,300 A * 2/1924 Grossman ..... 40/307
2,112,550 A * 3/1938 Amsden ..... 40/312
2,209,162 A * 7/1940 Hunt ..... 40/663
5,176,534 A * 1/1993 Nozick ..... 439/402
5,567,172 A * 10/1996 Thibault et al. ..... 439/371
5,620,335 A * 4/1997 Siemon ..... 439/491
5,821,510 A * 10/1998 Cohen et al. ..... 235/375
6,718,674 B2 * 4/2004 Caveney et al. ..... 40/642.02
6,785,131 B2 * 8/2004 Ewell et al. ..... 361/679.4
6,836,402 B1 * 12/2004 Huang ..... 361/601
6,966,581 B2 * 11/2005 Mastropaolo ..... 285/93
7,530,821 B2 * 5/2009 Miyake ..... 439/135
7,534,129 B2 * 5/2009 Boldy ..... 439/491
7,559,791 B1 * 7/2009 Kao et al. ..... 439/491
7,658,653 B2 * 2/2010 Diekmann et al. ..... 439/715
2004/0248436 A1 * 12/2004 Abe et al. ..... 439/76.1
2004/0266267 A1 * 12/2004 Inaba ..... 439/630
2005/0085121 A1 * 4/2005 Kukita et al. ..... 439/488
2006/0110962 A1 * 5/2006 Powell et al. ..... 439/169
2007/0128899 A1 * 6/2007 Mayer ..... 439/152
2007/0184719 A1 * 8/2007 Ni et al. ..... 439/610
2007/0224879 A1 * 9/2007 Beilenhoff et al. ..... 439/501
2007/0298649 A1 * 12/2007 Amidon ..... 439/488
2008/0108236 A1 * 5/2008 Stockel ..... 439/159
2009/0199448 A1 * 8/2009 Baba et al. ..... 40/642.02

* cited by examiner

*Primary Examiner*—T C Patel
*Assistant Examiner*—Vladimir Imas
(74) *Attorney, Agent, or Firm*—Zhigang Ma

(57) ABSTRACT

A connector provides convenience of identifying a network cable connected to the connector. A label with information of the network cable can be put on a connection portion which is mounted to a main body of the connector or be tied to a grommet of the connector.

9 Claims, 3 Drawing Sheets

CONNECTOR WITH A NETWORK CABLE IDENTIFIER

BACKGROUND

1. Technical Field

The present disclosure relates to connectors, and particularly to a connector for conveniently identifying a network cable connected to the connector.

2. Description of Related Art

A switch device or a router may be connected to many different network cables via corresponding connectors. To identify the network cables, the network cables or the connectors may be marked by attaching labels or using a pen to write some symbols on surfaces of the network cables or the connectors. However, the labels are easy to fall off, fade away, or be worn out.

DETAILED DESCRIPTION

Figure 1:
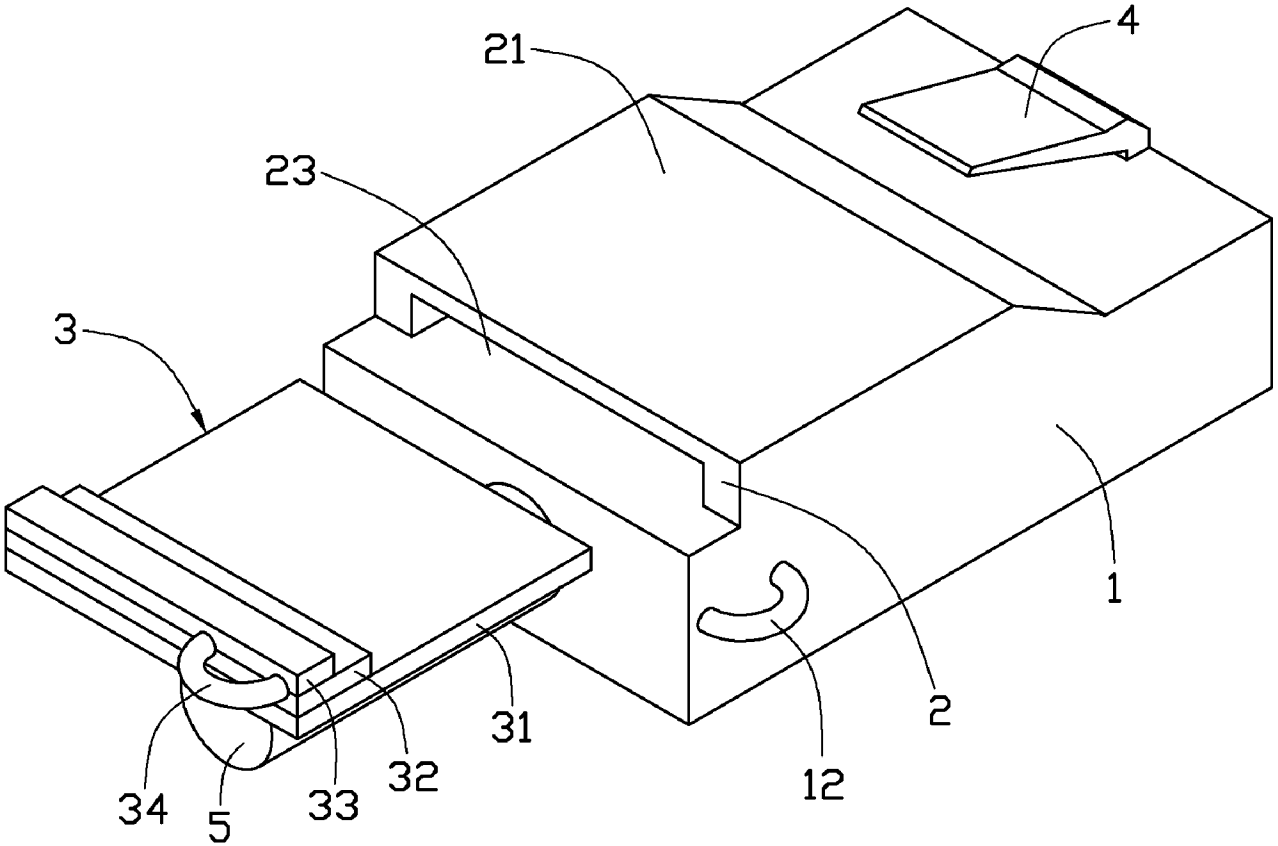
FIG. 1 is an exploded, isometric view of an exemplary embodiment of a connector.
Figure 2:
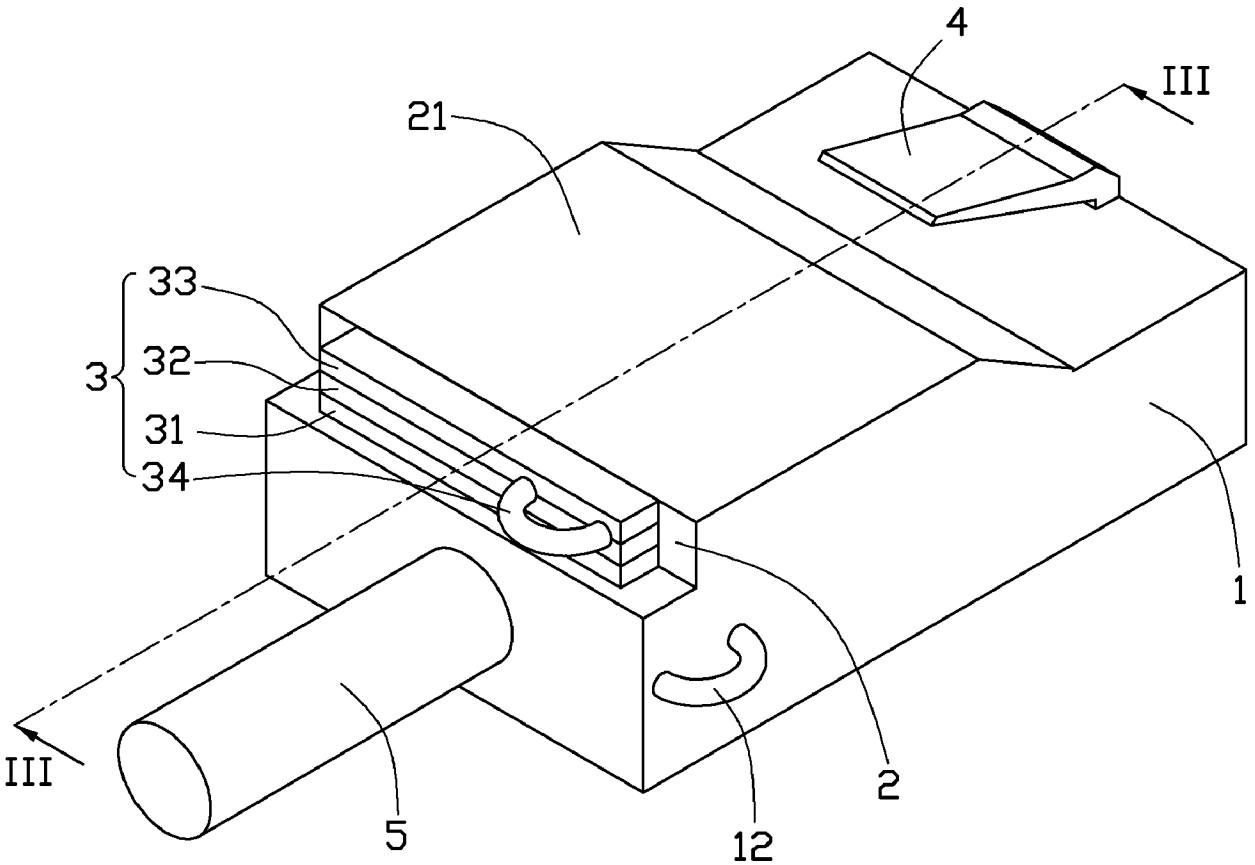
FIG. 2 is an assembled, isometric view of the connector of FIG. 1.
Figure 3:
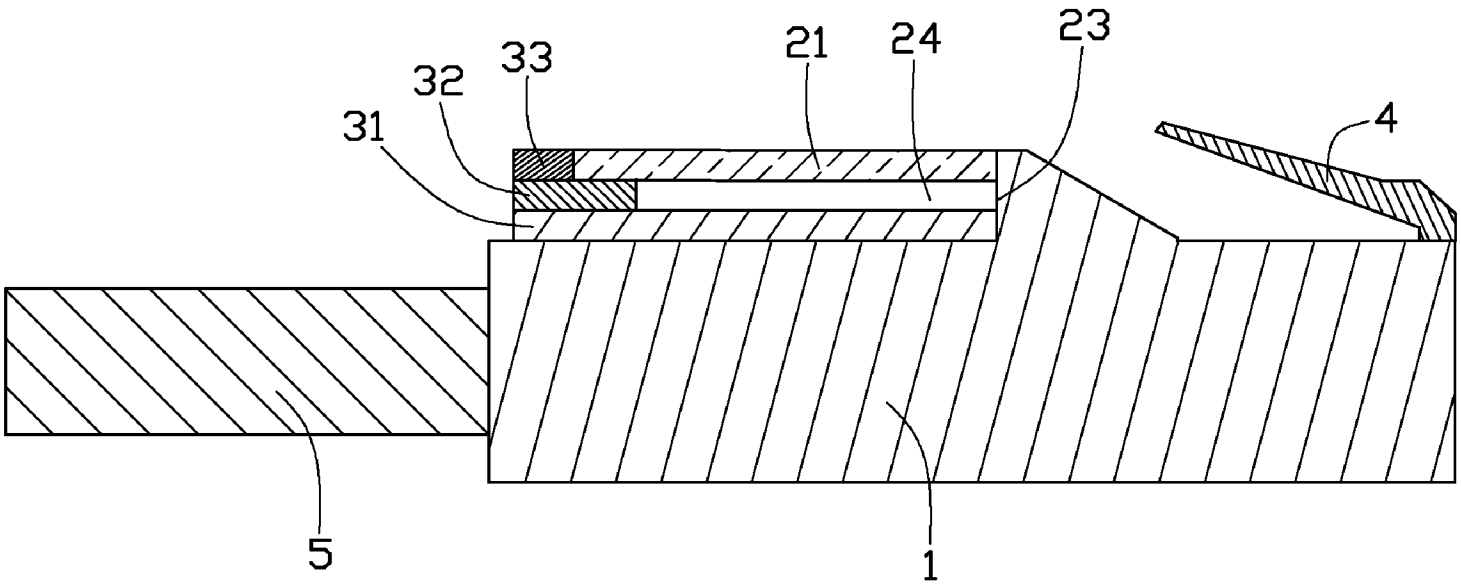
FIG. 3 is a cross-sectional view of FIG. 2, taken along the line III-III.

Referring to FIGS. 1 to 3, an exemplary embodiment of a connector is provided to connect to a network cable 5, and can be inserted into a network interface of a terminal device to connect the network table 5 to the terminal device. The connector includes a substantially rectangular-shaped main body 1 and a connection portion 3 for being inserted into the main body 1.

The network cable 5 extends from a front end of the main body 1. A grommet 12 is formed on a sidewall perpendicularly connected to the front end of the main body 1. A receiving portion 2 is formed on a top of the main body 1. A top wall 21 of the receiving portion 2 is made of transparent material. A receiving space 23 is defined between the top wall 21 and the main body 1. An elastic latch member 4 is formed on the top of the main body 1, adjacent to a back end of the main body 1, to be mounted to the network interface of the terminal device.

The connection portion 3 is substantially stepped, and includes a first layer 31, a second layer 32, and a third layer 33. Front sides of the first layer 31, the second layer 32, and the third layer 33 are coplanar. A sum of a height of the first layer 31 and a height of the second layer 32 is interference-fitted with a height of the receiving space 23. A length of the first layer 31 is greater than a length of the second layer 32. The length of the second layer 32 is greater than a length of the third layer 33. A grommet 34 is formed on the front side of the connection portion 3.

In assembly, a label with information of the network cable 5 is put on the first layer 31, a back side of the first layer 31 and the second layer 32 are inserted into the receiving space 23, with a back side of the third layer 33 of the connection portion 3 resisting against a front side of the top wall 21. Because the sum of the height of the first layer 31 and the height of the second layer 32 is interference-fitted with the height of the receiving space 23, the second layer 32 can resist against a bottom of the top wall 21 tightly. In one embodiment, the label can be tied to the grommet 12 or 34 by a string.

In use, from the transparent top wall 21, users can see the label to identify the network cable 5 connected to the connector when the label is put on the third layer 33. In another embodiment, users can identify the network cable 5 from the label tied to the grommet 12 or 34 by a string.

It is to be understood, however, that even though numerous characteristics and advantages of the embodiments have been set forth in the foregoing description, together with details of the structure and function of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A connector for connecting to a network cable, the connector comprising:

a main body comprising a receiving portion on a top of the main body; and a connection portion mounted to the receiving portion, wherein a label with information of the network cable is put on the connection portion, and the label is visible through the receiving portion;

wherein a receiving space is defined in the receiving portion to receive the connection portion, the connection portion is stepped and comprises a first layer and a second layer mounted on the first layer, a height of the first layer and a height of the second layer together are interference-fitted within a height of the receiving space, thereby making the second layer resist against a bottom of the receiving space.

2. The connector of claim 1, wherein the receiving portion comprises a transparent top wall so that the label is visible through the transparent top wall.

3. The connector of claim 1, wherein the connection portion further comprises a third layer mounted on the second layer, and the third layer resists against a front side of the receiving portion.

4. The connector of claim 3, wherein front sides of the first layer, the second layer, and the third layer are coplanar.

5. A connector for connecting to a network cable, the connector comprising:

a stepped connection portion comprising a first layer and a second layer mounted on the first layer; and a main body with the network cable extending from a front end of the main body, the main body comprising a receiving portion on a top of the main body, wherein a receiving space is defined in the receiving portion to receive the connection portion, and a grommet is formed on a sidewall of the main body, to fix a label with information of the network cable;

wherein a height of the first layer and a height of the second layer together are interference-fitted within a height of the receiving space, thereby making the second layer resist against a bottom of the receiving space; and wherein the label may be put on the connection portion and be visible through the receiving portion.

6. A connector connected to a network cable, the connector comprising:

a main body with the network cable extending from a front end of the main body, the main body comprising a receiving portion on a top of the main body, wherein a receiving space is defined in the receiving portion; and a stepped connection portion received in the receiving space, the connection portion comprising a first layer and a second layer mounted on the first layer, wherein a height of the first layer and a height of the second layer together are interference-fitted within a height of the receiving space, thereby making the second layer resist against a bottom of the receiving space, and a grommet is formed on a front side of the connection portion to fix a label;

wherein the label may be put on the connection portion and be visible through the receiving portion.

7. The connector of claim 6, wherein the receiving portion comprises a transparent top wall so that the label is visible through the transparent top wall.

8. The connector of claim 6, wherein the connection portion further comprises a third layer mounted on the second layer, and the third layer resists against a front side of the receiving portion.

9. The connector of claim 8, wherein front sides of the first layer, the second layer, and the third layer are coplanar.

* * * * *